US008597164B2

(12) United States Patent
Francis et al.

(10) Patent No.: US 8,597,164 B2
(45) Date of Patent: Dec. 3, 2013

(54) PERSONAL EXERCISE DEVICE

(75) Inventors: Paul S. Francis, Overbrook, KS (US); Teryl Kent Rouse, Kansas City, MO (US)

(73) Assignee: Spiraflex, Inc., Kansas City, MO (US)

( * ) Notice: Subject to any disclaimer, the term of this patent is extended or adjusted under 35 U.S.C. 154(b) by 0 days.

(21) Appl. No.: 13/450,206

(22) Filed: Apr. 18, 2012

(65) Prior Publication Data

US 2013/0065740 A1 Mar. 14, 2013

Related U.S. Application Data

(60) Provisional application No. 61/533,202, filed on Sep. 10, 2011.

(51) Int. Cl.
*A63B 21/02* (2006.01)

(52) U.S. Cl.
USPC ..... 482/122; 482/121

(58) Field of Classification Search
USPC ..... 482/92, 100–102, 121–126, 133, 148, 482/44–50, 91, 127, 139
See application file for complete search history.

(56) References Cited

U.S. PATENT DOCUMENTS

| | | | | |
|---|---|---|---|---|
| 4,374,588 | A | 2/1983 | Ruggles | |
| 5,209,461 | A | 5/1993 | Whightsil, Sr. | |
| 5,507,712 | A | 4/1996 | Chang | |
| 5,690,596 | A * | 11/1997 | Parker | 482/126 |
| 5,720,701 | A | 2/1998 | Truini | |
| 5,743,830 | A * | 4/1998 | Ho | 482/44 |
| 6,126,580 | A | 10/2000 | Francis et al. | |
| 6,440,044 | B1 | 8/2002 | Francis et al. | |
| D521,087 | S | 5/2006 | Francis | |
| 7,229,391 | B2 | 6/2007 | Francis | |
| 7,306,549 | B2 | 12/2007 | Francis | |
| 7,828,704 | B1 | 11/2010 | Hsieh et al. | |
| 7,878,955 | B1 | 2/2011 | Ehrlich et al. | |
| 2005/0233878 | A1 | 10/2005 | Wen | |
| 2007/0238590 | A1 * | 10/2007 | Jin | 482/121 |
| 2009/0239722 | A1 * | 9/2009 | Bisson | 482/126 |
| 2010/0204024 | A1 | 8/2010 | Mills et al. | |

OTHER PUBLICATIONS

International Serch Report and Written Opinion of the International Searching Authority, PCT/US2012/054468, Nov. 26, 2012.

* cited by examiner

*Primary Examiner* — Loan Thanh
*Assistant Examiner* — Andrew S Lo
(74) *Attorney, Agent, or Firm* — Erickson, Kernell, Derusseau & Kleypas, LLC

(57) ABSTRACT

A personal exercise device comprising a first arm pivotally coupled to a second arm wherein each arm includes a handle removably nesting in a sleeve. The personal exercise device further includes two tension members wherein one end each tension member is operably coupled to a handle of each arm and the other end of each tension member is coupled to the sleeve opposing the handle. A resistance element is operably connected to both the first arm and the second arm and configured to provide resistance between the relative rotational motion of the first arm and the second arm. The resistance element may be configured to be operably connected to other resistance elements to allow a user to customize, increase or decrease the resistance. The configuration of the personal exercise device provides a user the ability to seamlessly encounter resistance when applying force in at least two opposing directions.

20 Claims, 13 Drawing Sheets

PERSONAL EXERCISE DEVICE

CROSS-REFERENCE TO RELATED APPLICATIONS

This application claims the benefit of U.S. Provisional Patent Application No. 61/533,202 having a filing date of Sep. 10, 2011 which is incorporated herein by reference to the extent permitted by law.

BACKGROUND OF THE INVENTION

Personal exercise devices are plentiful in the commercial marketplace. However, there are many shortcomings that make personal exercise devices inconvenient and cumbersome to use. Most personal exercise devices limit the user to resistance for motion in only one direction. This is undesirable because there are many benefits to working out opposing body parts equally and in the same motion. Moreover, some personal exercise devices may provide the user the ability to adjust the direction of motion that is resisted; however, all of these devices require that the user reconfigure the device, change grips, or make other physical modification to the device or the user's position in order for the user to move the device in an opposite direction. Constantly reconfiguring the device, the user's position, and/or changing handles or grips introduces wasted time that needlessly increases the duration of the exercises and does not allow the user to benefit from the effective continuous range of motion that can be achieved by a machine that resists motion in two substantially opposing directions without any adjustment of handle grip, machine configuration, or the user's position.

Thus, there is a substantial need in the art for a personal exercise device that provides resistance training in two linear directions without requiring the user reposition his/herself, to reconfigure the exercise device, and/or change his/her grip on the device.

SUMMARY OF THE INVENTION

The present invention is directed toward a personal exercise device that includes a first arm pivotally coupled to a second arm at a pivot point, a first handle assembly operably connected to the first arm, a second handle assembly operably connected to the second arm, a first tension member operably connected to both the first handle assembly and the second arm, a second tension member operably connected to both the second handle assembly and the first arm, and a resistance member configured to provide resistance against the relative rotation of the first arm and the second arm about the pivot point.

The handle assemblies include a handle and a sleeve wherein the handle may nest within the sleeve and may be housed within the sleeve. The sleeve may be coupled to the arm at or near one end. One embodiment includes the first tension member being coupled to the first handle at one end and to the second sleeve at the other end. Likewise, the second tension member may be coupled to the second handle at its first end, and to the first sleeve at its second end. A user applies a force upon the handle to effectuate the movement of the arms relative to each other. When the user applies an adduction force to the handles (pushing the handles together), the handles remain housed in the sleeve, and the user's opposing body parts applying the force (for example, his/her hands) and the arms of the device are both moving toward each other. The resistance member may be configured to resist the arms of the device from being rotated relative to each other.

For a user to apply an abduction force (pulling handles away from each other), the handles de-nest and are pulled out of the sleeve. When the abduction force is applied to the handles, the tension members are engaged and the personal exercise device of the present invention resists the abduction motion applied by the user. When an abduction force is applied to the handles, the handles engage the tension members thereby exerting a force on the arm opposite the handle. As a result, when the user's body parts (for example, his/her hands) are moving away from each other, the arms of the personal exercise device of the present invention are being moved toward each other thereby engaging the resistance member similarly to applying the adduction force. The personal exercise device of the present invention may be particularly notable as this configuration allows for continuous motion in two opposing linear directions without a user having to reconfigure the device or adjust his/her grip.

The resistance member may be any known mechanical, hydraulic, or elastomeric element known and configured to resist relative rotational movement between the two arms of the device. One embodiment includes an elastomeric resistance element with a known resistance force. The elastomeric resistance element may be configured with a plurality of spokes between a hub and an outer rim. The spokes are configured to wrap and stretch about the hub upon rotation of the hub relative to the rim. The elastomeric resistance element may be configured between a front plate and a back plate in a self-contained "flex pack." Multiple resistance flex packs may be sistered to each other to adjust the resistance provided. One embodiment of the present invention includes the configuration of the arms and the resistance element providing a substantially uniform resistance force as the moment arm of the applied force increases at substantially the same or similar rate as the increase in resistance caused by the material properties and effective length of the resistance spokes.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views, and wherein.

DETAILED DESCRIPTION OF THE INVENTION

The following detailed description of the invention references the accompanying drawing figures that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and, therefore, the description is not to be taken in a limiting sense and shall not limit the scope of equivalents to which such claims are entitled.

Figure 1:
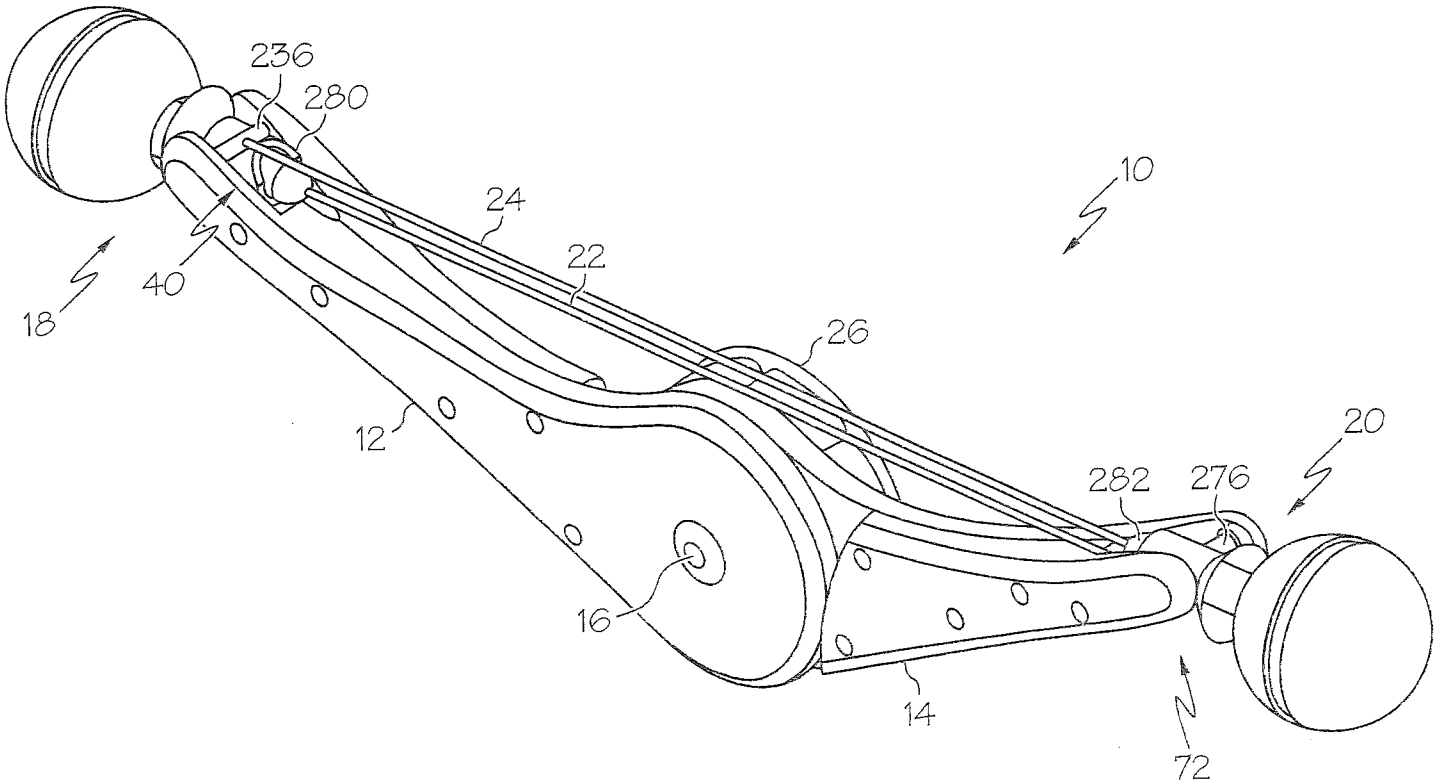
FIG. 1 is a perspective view of one embodiment of the personal exercise device in accordance with the teachings of the present invention.

As illustrated in FIG. 1, the present invention is directed toward a personal exercise device 10 including a first arm 12 pivotally coupled to a second arm 14 at a pivot point 16, first arm 12 including a first handle assembly 18 operably connected thereto, and the second arm 14 including a second handle assembly 20 operably connected thereto. Personal exercise device further includes tension member 22 operably connected to both first handle assembly 18 and second handle assembly 20, a second tension member 24 operably connected to both second handle assembly 20 and first handle assembly 18, and a resistance member 26 configured to provide resistance against the relative rotation of first arm 12 and second arm 14.

Figure 2:
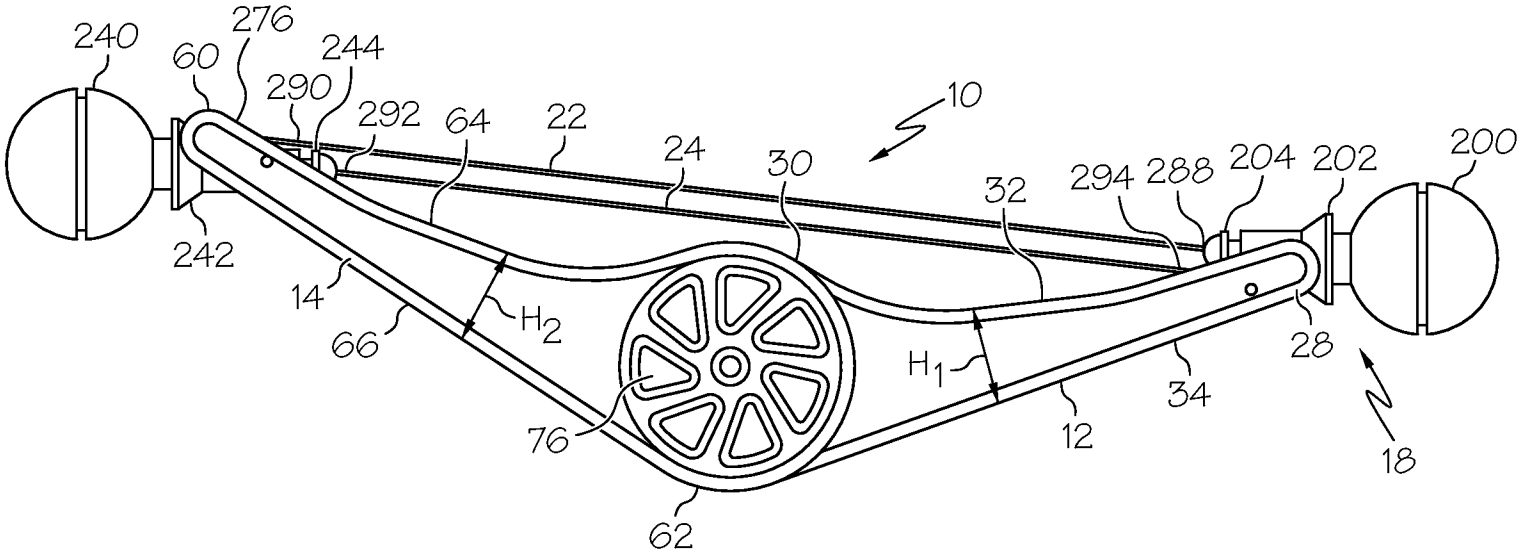
FIG. 2 is a side view of the embodiment of the personal exercise device of FIG. 1.
Figure 3:
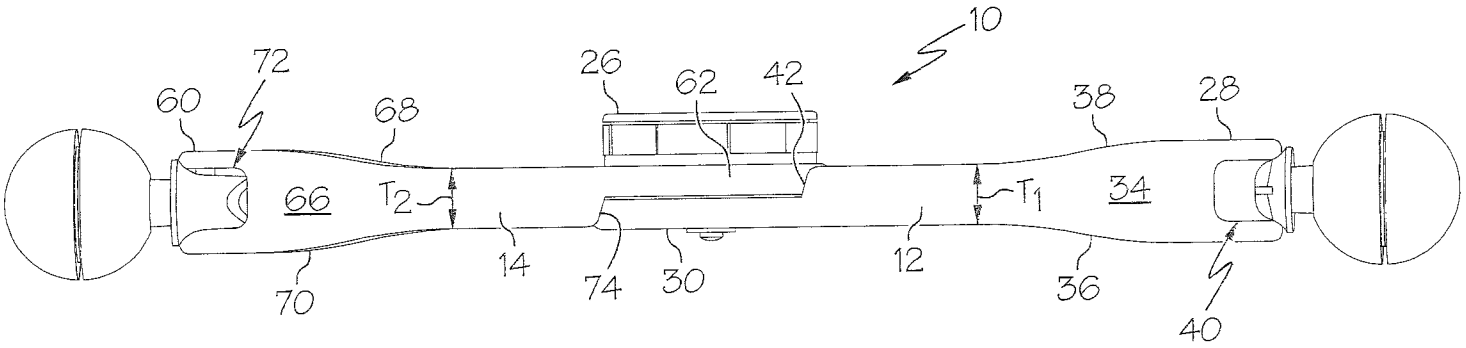
FIG. 3 is a bottom view of the embodiment of the personal exercise device of FIG. 1.

As shown in FIG. 2, first arm 12 includes a first end 28, a second end 30, a top face 32, and a bottom face 34 wherein the distance between top face 32 and bottom face 34 defines height $H_1$. An embodiment of first arm 12 includes height $H_1$ increasing gradually from first end 28 to second end 30 as shown. FIG. 3 further illustrates first arm 12 including a front face 36 and a back face 38 wherein the distance between front face 36 and back face 38 defines a thickness $T_1$. One embodiment of first arm 12 includes first end 28 having a fork 40 and second end 30 including a step 42 in thickness $T_1$ as shown.

Figure 4:
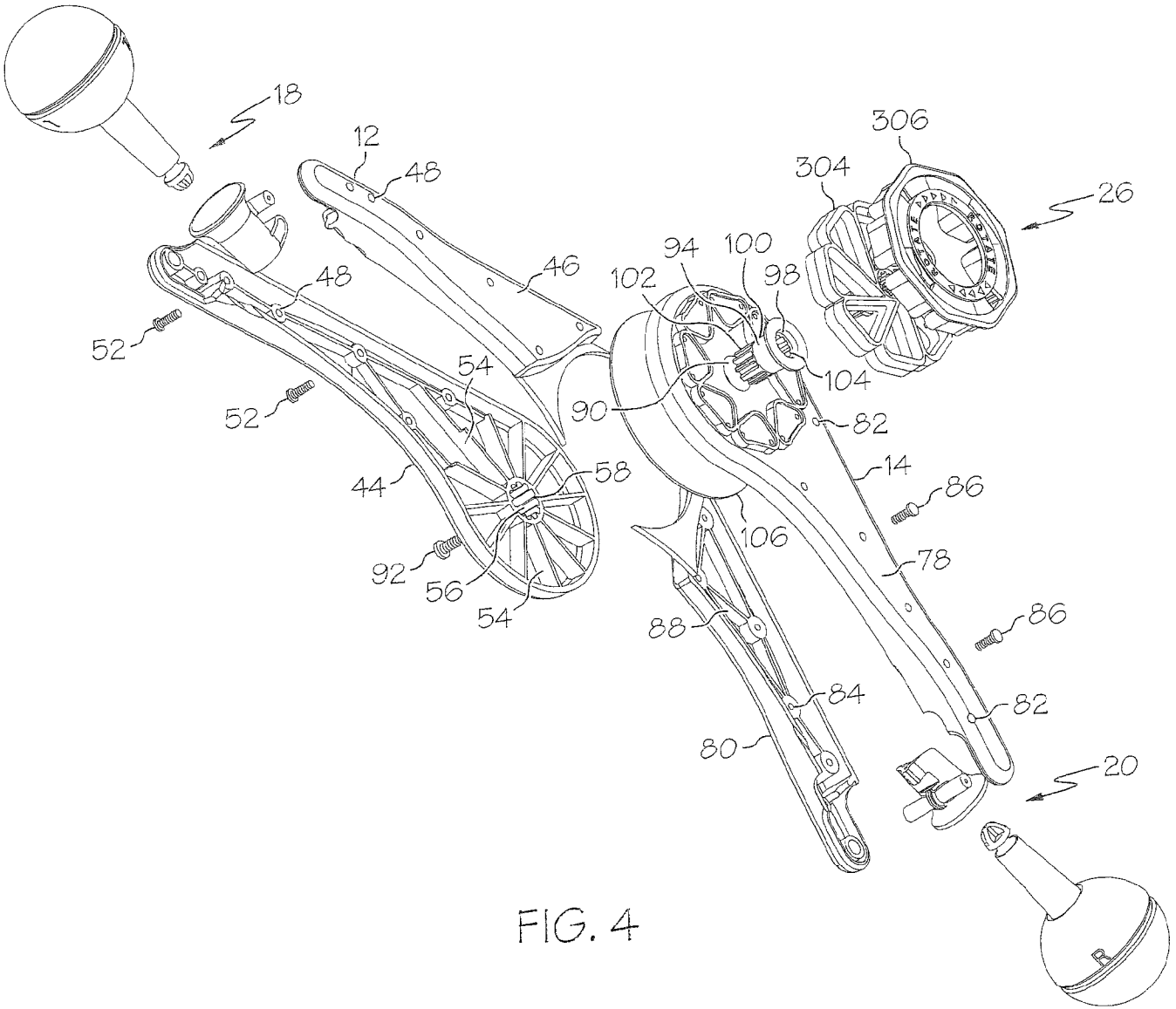
FIG. 4 is a blown-up perspective view of the embodiment of the personal exercise device of FIG. 1.

As shown in FIG. 4, one embodiment of first arm 12 includes a front half 44 and a back half 46. Front half 44 includes one or more apertures 48 therethrough that line up with an inwardly extending threaded projection 50 (not shown) on back half 46. An arm fastener 52 is inserted through each aperture 48 and received into threaded projection 50 to couple front half 44 to back half 46. Further, each half 44 and 46 may include one or more stiffeners 54 to increase the rigidity and strength of first arm 12. First arm 12 further includes an aperture 56 defined in second end 30 wherein aperture 56 includes a plurality of teeth 58 defined therein.

Now referring back to FIG. 2, second arm 14 includes a first end 60, a second end 62, a top face 64, and a bottom face 66 wherein the distance between top face 64 and bottom face 66 defines height $H_2$. One embodiment of second arm 14 includes height $H_2$ increasing gradually from first end 60 to second end 62 as shown. FIG. 3 illustrates an embodiment of second arm 14 having a front face 68 and a back face 70 wherein the distance between front face 68 and back face 70 defines a thickness $T_2$. An embodiment of second arm 14 includes first end 60 having a fork 72 and second end 62 including a step 74 in thickness $T_2$ as shown. As best shown in FIG. 2, front face 68 of second arm 14 may include a plurality of projections 76 configured to engage resistance member 26.

FIG. 4 illustrates one embodiment of second arm 14 including a front half 78 and a back half 80. Front half 78 includes one or more apertures 82 therethrough that line up with an inwardly extending threaded projection 84 on back half 80. An arm fastener 86 is inserted through each aperture 82 and received into a corresponding threaded projection 84 thereby coupling front half 78 to back half 80. Further, each half 78 and 80 may include one or more stiffeners 88 to increase the rigidity and strength of second arm 14 as shown. Second arm 14 further includes an aperture 90 defined in second end 62 wherein aperture 90 is a substantially smooth bore.

Arms 12 and 14 may be a solid shape either machined, molded or both. Alternatively, arms 12 and 14 may be a hollow shape that is extruded or molded. Arms 12 and 14 may have a cross-section having a shape that is round, rectangular, triangular, or other shape and the cross-section may be uniform along the length or may have a variable height similar to that described above. Arms 12 and 14 may have any functional length and one embodiment includes the length being selected based upon ergonomic considerations. The length of arms 12 and 14 may also vary depending on the type of exercises, or the body parts intended to be exercised by the user using personal exercise device 10.

Arms 12 and 14 may be constructed from UHMW polyethylene, low-density polyethylene, high-density polyethylene, polyvinyl chloride (PVC), polypropylene, wood, aluminum, steel, brass, copper, glass, carbon fiber, composite polymer materials or any other suitable material now known or hereafter discovered that has the physical properties to transfer the force applied to handle assemblies 18, 20 to the resistance member 26. It is preferred that arms 12 and 14 are configured such that the combination of the material and cross-section provide the structural integrity required to transfer the force applied to the ends of arms 12 and 14 to the resistance member 26.

Arms 12 and 14 may be constructed of multiple pieces or may be of unitary construction. Any coupling method now known or hereafter developed can be used to couple the pieces of the arms including through-bolts, screws, snap connection, adhesive, welds, laser weld, rivet, or any other coupling method now known or hereafter developed. The machining of arms 12 and 14 may be done manually, or may be performed by any automatic machining system known in the art. Automatic manufacturing may be performed in a CAD/CAM system. An alternative method of manufacture includes injection molding, compression molding, resin transfer molding, transfer molding of composite materials or metals, or any other molding method now known or hereafter developed. In addition to the methods identified above, arms 12 and 14 may be manufactured using any manufacturing method now known or hereafter developed that is capable of creating arms 12 and 14 corresponding to the description herein.

As further shown in FIG. 4, first arm 12 is coupled to second arm 14 by fastener 92 at pivot point 16. An embodiment of the present invention shown includes an insert 94 being inserted through aperture 90 of second end 62 of second arm 14 wherein insert 94 is configured to threadably receive fastener 92 to pivotally couple first arm 12 to second arm 14 at pivot point 16. As shown, insert 94 has a substantially tubular cross-section including an outer surface 96 and an inner surface 98. Outer surface 96 includes a smooth portion 100 and a toothed portion 102 wherein toothed portion 102 is configured to be complimentary with and matingly engage teeth 58 of aperture 56 of first arm 12 and the smooth portion 100 is configured to engage with smooth aperture 90 of second arm 14 and allow substantially frictionless relative rotation of second arm 14 in relation to insert 94. Teeth 58 and toothed portion 102 may be any mating configuration capable of transferring torque from first arm 12 to a portion of resistance member 26 so that relative motion between first arm 12 and second arm 14 engages resistance member 26.

An embodiment of the present invention may also include inner surface 98 of insert 94 having teeth 104 defined therein that will engage a portion of resistance member 26 as described below. As shown in FIG. 4, a washer 106 may be positioned between first arm 12 and second arm 14. One embodiment includes washer 106 being of a friction-reducing material thereby reducing the frictional force resisting relative rotational motion between arm 12 and arm 14. Washer 106 may be any friction reducing material known in the art including nylon, PVC, UHMW plastic, polyolefin, polyethylene, or other known material having a low coefficient of friction.

Figure 5A:
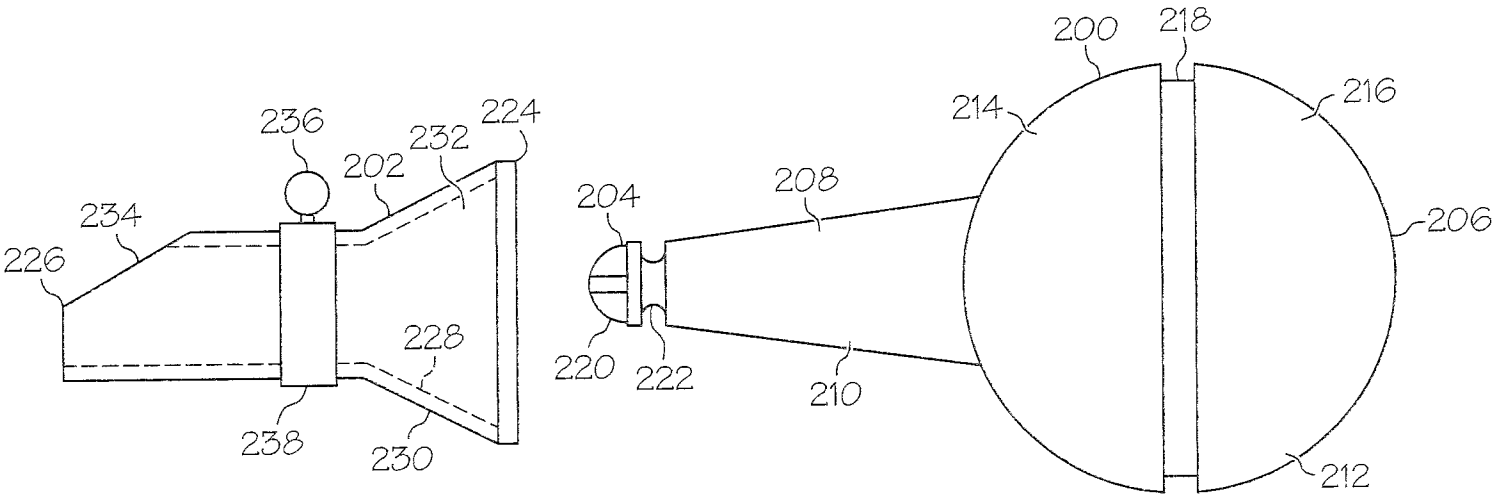
FIG. 5A is a side view of one embodiment of a handle of a personal exercise device in accordance with the teachings of the present invention.

Personal exercise device 10 may also include a first handle assembly 18 having a first handle 200 and a first sleeve 202 wherein a portion of handle 200 removably nests within first sleeve 202 as shown in FIG. 2. FIG. 5A illustrates handle 200 including a first end 204, a second end 206, and an outer surface 208. An embodiment of handle 200 further includes a nesting portion 210 proximate first end 204 and a handhold 212 proximate second end 206. In one embodiment, nesting portion 210 is substantially cylindrical. In another embodiment, nesting portion 210 is frustoconical with the narrow end proximate first end 204. An embodiment of nesting portion 210 of first handle 200 may further include knob 220 and notch 222 as shown.

In one embodiment, handhold 212 is substantially spherical and includes a first hemisphere 214, a second hemisphere 216 and a recess 218 defined between first and second hemispheres 214 and 216. First hemisphere 214 is coupled to nesting portion 210. Another embodiment includes second hemisphere 216 being detachable from first hemisphere 214 to allow for an accessory (not shown), such as a strap (not shown), to be coupled to first hemisphere 214 of personal exercise device 10 and a user may use the strap to attach or hold the device 10 with a body part such as an arm, leg, or foot or any other substantially fixed object. Recess 218 may also be configured to receive a strap or other accessory to facilitate variations on the exercises that are able to be performed using the personal exercise device 10 of the present invention.

As further illustrated in FIG. 5A, first sleeve 202 has a tubular shape and includes a first end 224, a second end 226, an inner surface 228 and an outer surface 230 wherein inner surface 228 and outer surface 230 define a tubular wall. One embodiment includes first sleeve 202 having a cylindrical shape and another embodiment includes first sleeve 220 having a frustoconical shape with its narrower end proximate second end 226. Sleeve 202 is configured to receive nesting portion 210 of handle 200 wherein handle 200 engages sleeve 202 when a compression force is applied to the handles. An embodiment of the present invention may include first end 224 of first sleeve 202 having a flared portion 232 to assist in seating nesting portion 210 of first handle 200 within first sleeve 202. Second end 224 of first sleeve 202 may also include a cutback 234 of a portion of the tubular wall. Cutback 234 is configured to prevent sleeve 202 from engaging the tension members 22 and 24 during operation of the device. Embodiments of sleeve 202 may also include a pivot rod 236 coupled to sleeve 202 by connection band 238. Another embodiment includes pivot rod 236 being integral with sleeve 202 as shown in FIG. 4. FIG. 1 illustrates one embodiment including pivot rod 236 being configured to be rotatably coupled within fork 40 of first arm 12 and/or be coupled to one end of a tension member 24. Pivot rod 236 may pivot relative to first arm 12 to allow for the user to apply force from a variety of different angles, one of which is normal to the radial direction of arm 12.

Figure 5B:
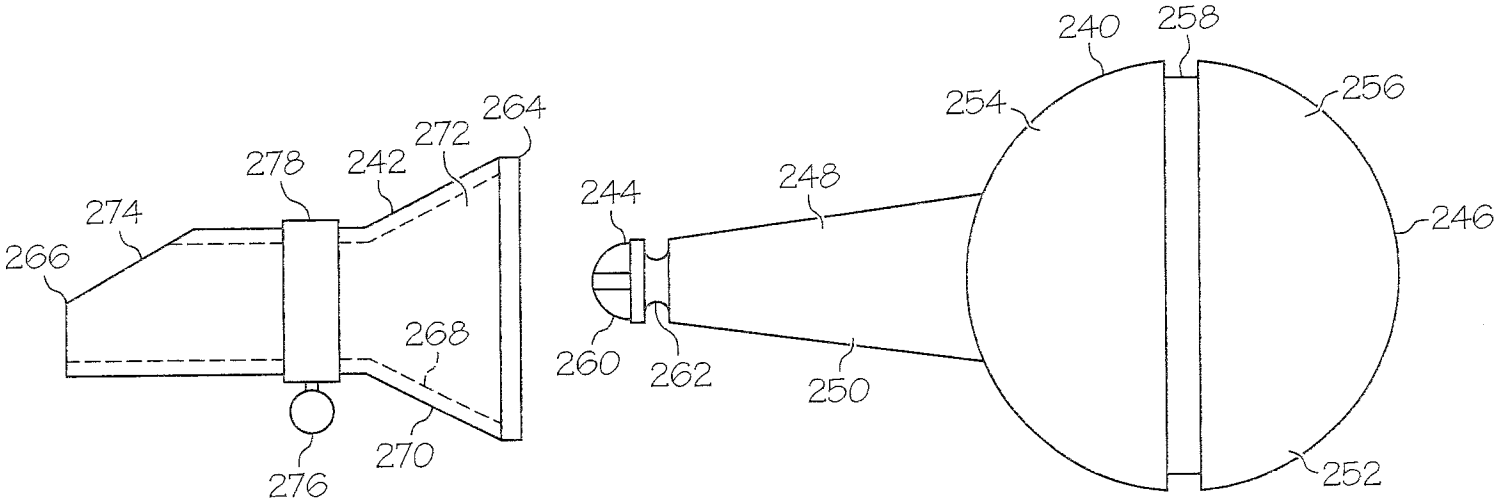
FIG. 5B is a side view of one embodiment of a handle of a personal exercise device in accordance with the teachings of the present invention.

Now turning back to FIG. 2, personal exercise device 10 includes a second handle assembly 20 having a second handle 240 and a second sleeve 242 wherein a portion of handle 240 removably nests within second sleeve 242. One embodiment includes second handle 240 being substantially similar to handle 200 as describe above. As shown in FIG. 5B, handle 240 includes a first end 244, a second end 246, and an outer surface 248. An embodiment of handle 240 further includes a nesting portion 250 and a handhold 252. One embodiment of handhold 252 includes a first hemisphere 254, a second hemisphere 256 and a recess 258 defined between first and second hemispheres 254, 256. An embodiment of nesting portion 250 of first handle 240 may include knob 260 and notch 262 as shown. Another embodiment includes second hemisphere 256 being detachable from first hemisphere 254 to allow for an accessory (not shown), such as a strap (not shown), to be coupled to first hemisphere 254 of personal exercise device 10 and a user may use the strap to attach or hold the device with a body part such as an arm, leg, or foot or any other substantially fixed object. Recess 258 may also be configured to receive a strap or other accessory to facilitate variations on the exercises that are able to be performed using the personal exercise device 10 of the present invention.

As further shown in FIG. 5B, second sleeve 242 has a tubular shape and includes a first end 264, a second end 266, an inner surface 268 and an outer surface 270 defining a tubular wall. Sleeve 242 is configured to receive nesting portion 250 of handle 240. First end 264 of second sleeve 262 may include a flared portion 272 to assist in seating nesting portion 250 of second handle 240. Second end 266 of second sleeve 242 may also include a cutback 274 of a portion of the tubular wall. Embodiments of second sleeve 242 may also include a pivot rod 276 coupled to second sleeve 242 with a connection band 278. Another embodiment includes pivot rod 276 being integral with second sleeve 242. As shown in FIG. 1, pivot rod 276 is configured to be rotatably connected within fork 72 of second arm 14 and/or be coupled to one end of a tension member 22. Pivot rod 276 may be pivotable relative to second arm 14 to allow for the user to apply force from a variety of different angles, one of which is normal to the radial direction of arm 14.

Alternative embodiments include handle 200, 240 having any mechanism now known or hereafter developed to allow handle 200, 240 to engage sleeve 202, 242 when a compression force is applied to the handles 200 and 240 such as a tab or a ring extending away from handle 200 that is configured to bear against first end 224, 264 of sleeve 202, 242. One embodiment (not shown) includes handhold 212, 252 being a handle to be gripped by a user, such as a D-ring, circular handle, tubular handle, rope, or any other handle now known or hereafter developed. Handhold 212, 252 may also include any shaped portion now known or hereafter developed that is configured to be ergonomically gripped by a user. Handholds 212 and 252 are preferably configured to allow a user to easily change directions of the force without changing hand position thereby allowing the user to both pull and push on the handle in a continuous motion to effectuate movement of arms 12 and 14. This provides a significant increase in the range of motion provided by the device 10 over the existing art.

Handle assemblies 18, 20 may be constructed from UHMW polyethylene, low-density polyethylene, high-density polyethylene, polyvinyl chloride (PVC), polypropylene, wood, aluminum, steel, brass, copper, glass, carbon fiber, composite polymer materials, any combination thereof or any other suitable material now known or hereafter discovered having the physical properties necessary to transfer the force applied to handle assemblies 18, 20 to the arms 12, 14 and/or resistance member 26. Further, handle assemblies 18, 20 may be constructed of multiple pieces or may be of unitary construction. The machining of all or part of the handle assemblies 18, 20 may be done manually, or may be performed by any automatic machining system known in the art. Automatic manufacturing may be performed in a CAD/CAM system. An alternative method of manufacture includes injection molding, compression molding, resin transfer molding, transfer molding of composite materials or metals, and any other molding method known in the art. In addition to the methods identified above, handle assemblies 18, 20 may be manufactured using any manufacturing method now known or hereafter developed that is capable of handle assemblies 18, 20 as described herein.

Figure 6:
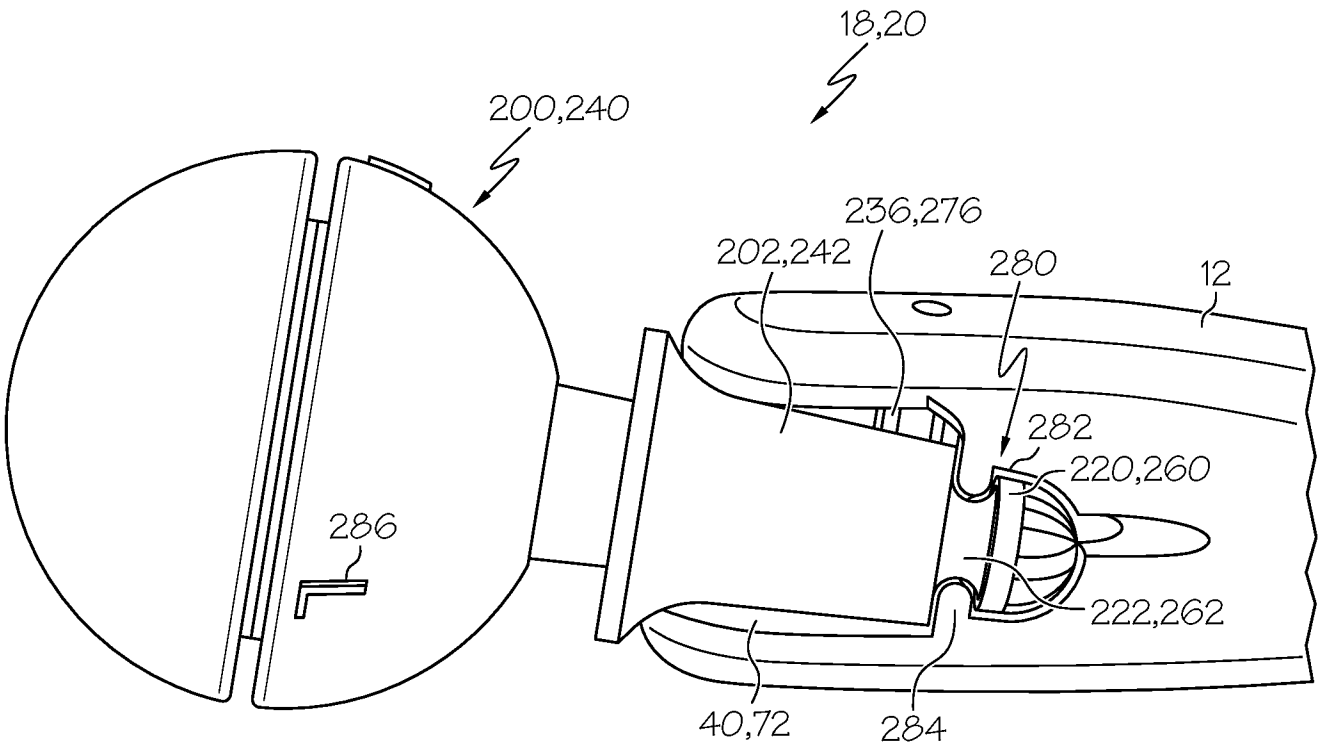
FIG. 6 is a blown up perspective view of one embodiment of the handle assembly of a personal exercise device in accordance with the teachings of the present invention.

As shown in FIG. 6, one embodiment of handle 200, 240 includes knob 220, 260 and notch 222, 262 are configured to engage a catch 280 of arm 12, 14. Catch 280 includes a housing 282 configured to receive knob 220, 260 and housing 282 further includes a rim 284 extending inwardly to engage notch 222, 262 of handle 200, 240. Thus, when knob 220, 260 is received into housing 282, handle 200, 240 is prevented from linear translation, in particular, preventing handle 200, 240 from disengaging and being pulled out of sleeve 202, 242. When handle 200, 240 is rotated about pivot rod 236, 276 to a certain position, particularly when a user is applying compressive force to the handles 18, 20 to effectuate moving the handles 18, 20 closer together, the notch 222, 262 nests into housing 282 of catch 280 of arm 12, 14 proximate near the confluence of fork 40, 72 as shown. When notch 222, 262 engages rim 284 of catch 280, rim 284 prevents handle 200, 240 from being removed from sleeve 202, 242 during applying an adduction force to the device. When a user wants to disengage catch 280, the handles may be rotated slightly in a direction opposite of the housing wherein notch 222, 262 disengages from rim 284 and handle 200, 240 may be removed from sleeve 202, 242.

As shown in FIG. 6, one embodiment of handles 200, 240 further includes an indicator 286 for which hand is to be placed on which handle 200, 240 so that the resistance member 26 extends outwardly from the user.

Now turning back to FIG. 2, first tension member 22 includes a first end 288 and a second end 290. First end 288 is operably connected to first end 204 of handle 200 and second end 290 is operably connected to pivot rod 276 of sleeve 242. Second tension member 24 includes a first end 292 and a second end 294. First end 292 is operably connected to first end 244 of handle 240 and second end 294 is operably connected to pivot rod 236 of sleeve 202. Tension members 22, 24 may be any substantially flexible tension member now known or hereafter developed wherein the tension member can carry tension load when a tension force is applied to the handles, but will not exert additional resistance when a compressive force is applied to the handles. Such tension members include wire, rope, string, monofilament, chain, metal or fabric band, or other like-behaving member. Tension members may be metal, rubber, plastic, cloth or any other material or combination thereof having the tensile strength and cross-sectional area necessary to carry the tension load through the member.

As shown in FIG. 4, resistance member 26 is configured to be attached to second arm 14 proximate the pivot point 16 of the device 10 and provide resistance against arms 12 and 14 being rotated relative to each other. Resistance member 26 may be any mechanical, hydraulic, or other resistance element that resists relative rotational motion between arm 12 and arm 14. Resistance member 26 may be adjustable in that the resistance force can be increased or decreased to suit a user's preference or needs. One embodiment of resistance member 26 incorporates many of the features of the torsional spring disclosed in U.S. Pat. No. 5,209,461 to Whightsil (the "'461 patent") and U.S. Pat. No. 6,440,044 to Francis et al. (the "'044 patent"), the teachings of which are hereby incorporated by reference to the extent permitted by law. Reference may be made to the '461 patent or the '044 patent for a more detailed description of the flex pack construction.

Figure 7:
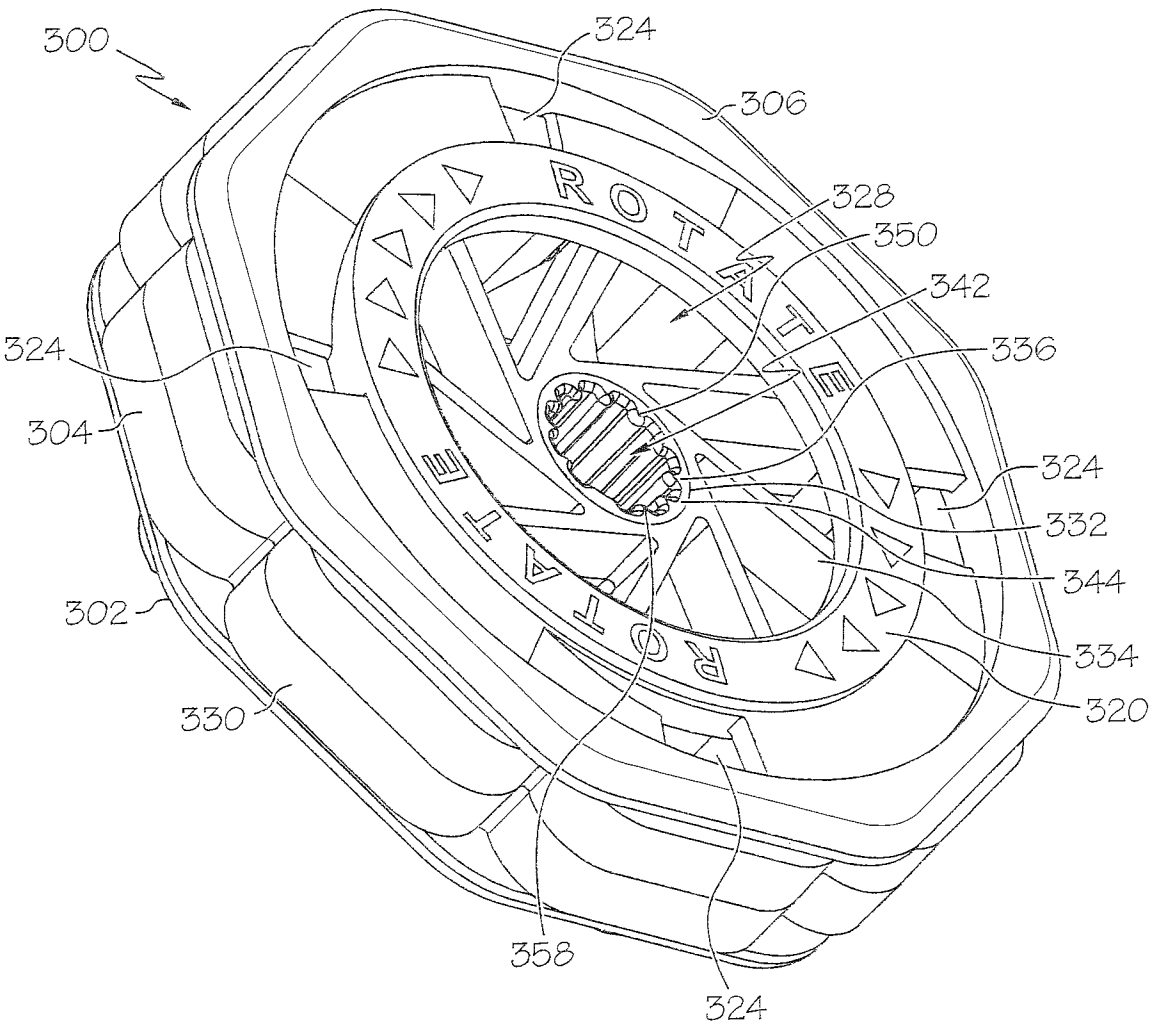
FIG. 7 is a perspective view of one embodiment of the resistance member of a personal exercise device in accordance with the teachings of the present invention.
Figure 8:
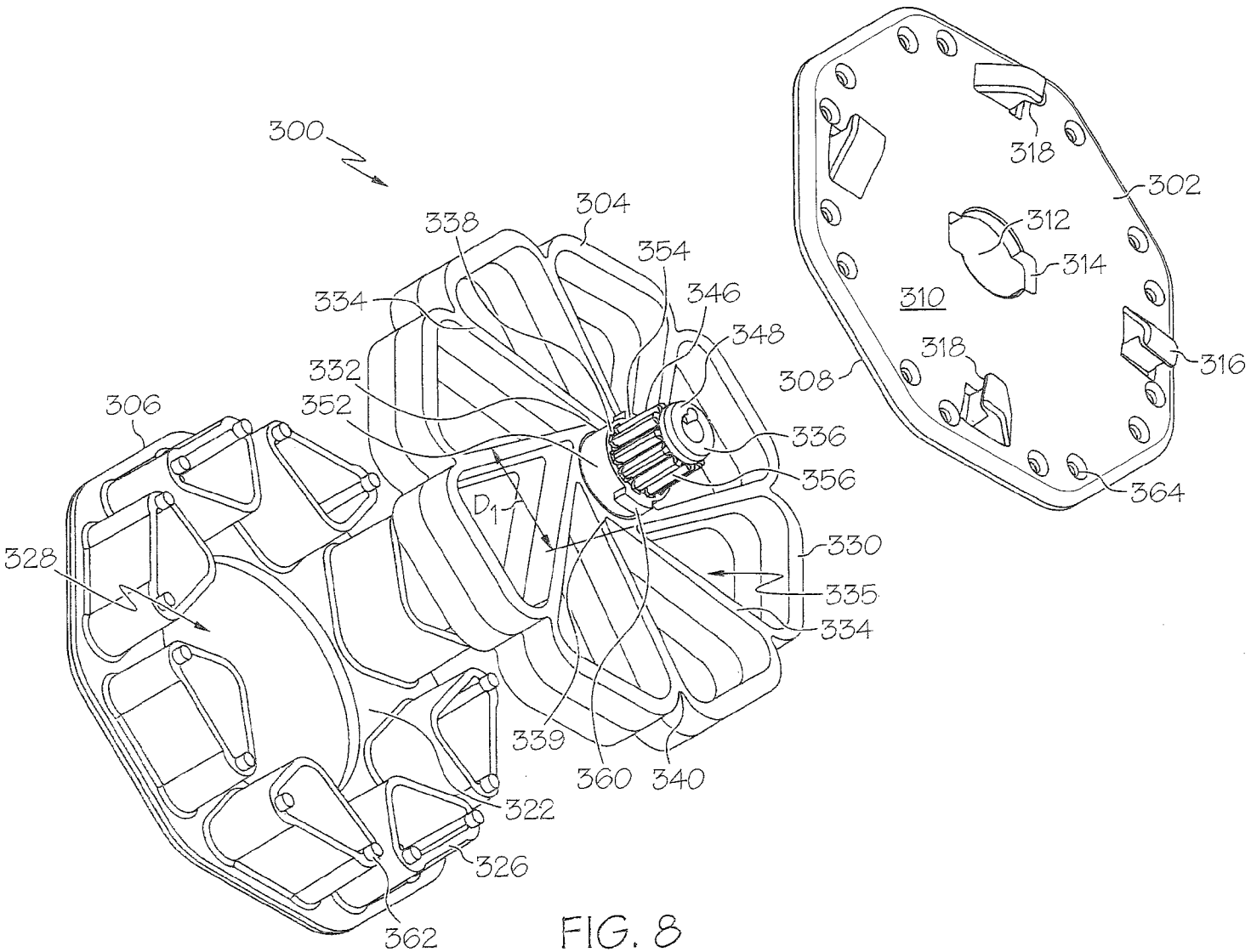
FIG. 8 is a blown up perspective view of the resistance member of the personal exercise device of FIG. 7.

One embodiment of resistance member 26 improves upon the teachings of the '461 and '044 patents and comprises at least one self-contained flex pack 300. FIG. 7 illustrates one embodiment of a self-contained flex pack 300 similar to the torsional spring of the '461 patent, but further improved and configured to be used in the personal exercise device 10 of the present invention. One embodiment of flex pack 300 includes a back plate 302, an elastomeric resistance element 304, and a front plate 306 wherein the elastomeric resistance element 304 is sandwiched between front plate 306 and back plate 302, wherein front plate 306 is permanently or temporarily coupled to back plate 302. Front plate 306 of flex pack 300 includes a front surface 320, a back surface 322 (shown in FIG. 8), and a plurality of tapered slots 324 configured to receive and engage a plurality of coupling arms 316 having a hook 318 of a back plate of another flex pack 300. Front plate 306 may also include an aperture 328 for viewing elastomeric resistance element 304 therethrough. As shown in FIG. 8, front plate 306 also includes a plurality of substantially triangular shaped projections 326 extending away from back surface 322.

As shown in FIG. 8, back plate 302 includes a front surface 308, a back surface 310, a center aperture 312 having wings 314 formed therein and a plurality of coupling arms 316 coupled to and extending away from back surface 310. Each coupling arm 316 may include a hook 318 formed at the end thereof as shown. Further, elastomeric resistance element 304 includes a rim 330, a hub 332, and a plurality of elastomeric spokes 334 extending therebetween. The hub 332 includes a substantially rigid hub arm 336 coupled to an elastomeric portion 338 of hub 332. The hub 332 further includes an outer diameter $D_1$ as shown. Each spoke 334 includes a first end 339, a second end 340, a cross-sectional area, and a length $L_1$. The plurality of spokes 334 are coupled to hub 332 at a substantially tangential angle to a circle defined by diameter $D_1$ and spokes 334 extend linearly outward from the hub 332 and wherein the second end 340 of spokes 334 is coupled to rim 330. Rim 330 may be stepped as shown in order to divide the resistance element 304 in combination with the spokes 334 to define a plurality of substantially triangular shaped apertures 335. One embodiment includes elastomeric resistance element 304 being injection molded around rigid hub arm 336. Alternatively, spokes 334 may be chemically welded or bonded to rim 330 and hub 332 using adhesive, heat, laser, mechanical fastener or any other method now known or hereafter developed. FIG. 8 further illustrates the plurality of projections 326 extending away from back surface 322 configured to fit between the spokes 334 and within apertures 335 of elastomeric resistance element 304 as shown.

Spokes 334 may be constructed from any elastomeric polymer material now known or hereafter developed. One embodiment includes a blend of natural rubber and polybutadiene, wherein a well-performing blend that has been found to have an acceptable fatigue life incudes about 80% natural rubber and about 20% polybutadiene. The amount of resistance provided by spokes 334 is a combination of the number of spokes, the length, the material's modulus of elasticity and the cross-sectional area of the spoke 334. As shown in FIG. 8, the cross-sectional area of spokes 334 may be substantially constant, whereas other embodiments may include a varying cross-sectional area to provide a variable resistance. Moreover, depending on the material properties of the spokes, the resistance will increase the further the material is elastically stretched. As such, the resistance increases the further hub 332 is rotated relative to rim 330. Spokes 334 may be configured to provide a certain equivalent resistance in "pounds" or "kilograms." For example, resistance member 26 may be configured with a two pound resistance, five pound resistance, ten pound resistance, or any other value or interval in pounds or kilograms.

FIG. 7 shows hub arm 336 being substantially tubular and having a female portion 342 proximate a first end 344 of hub arm 336 and an inside surface 350. FIG. 8 illustrates substantially rigid hub arm 336 extending way from elastomeric resistance element 304 and being substantially tubular having a male portion 346 proximate a second end 348 and male portion 346 has an outside surface 352. Inside surface 350 and outside surface 352 define a tube wall thickness. Hub arm 336 may include second end 348 being substantially closed. Hub arm 336 includes a step 354 in the cross-section between first end 344 and second end 348 due to male portion 346 having a lesser out-to-out dimension than the female portion 342 as shown in FIG. 8. At least a portion of outside surface 352 of male portion 346 includes a plurality of outside teeth 356 configured to engage inside surface 98 of insert 94 or the inside surface of the female portion of another similarly configured flex pack 300.

FIGS. 7 and 8 illustrate that inside surface 350 of female portion 342 includes a plurality of complementary inside teeth 358 and is configured to receive the male portion of another similarly configured resistance element wherein inside teeth 358 will engage outside teeth 356 of male portion 346 to drivingly engage the additional resistance elements when torque is applied. Using the above configuration, multiple flex packs 300 may be sistered together to allow a user to configure the device to provide the desired resistance. Further, inside teeth 358 and outside teeth 356 may be selectively distributed around the circumference of the inside and outside surfaces to ensure proper alignment when another flex pack 300 is sistered and coupled to an already engaged flex pack 300.

As further illustrated in FIG. 8, hub arm 336 may further include one or more tabs 360 configured to pass through wings 314 of back plate 302. As shown in FIG. 8, hub arm 336 includes two opposing tabs 360, but any number may be used. Tabs 360 slide through wings 314 during assembly, and hub arm 336 is rotated such that tabs 360 are positioned to bear against back surface 310 of back plate 302. Tabs 360 are configured to prevent hub arm 336 and elastomeric element 304 from displacing away from an adjacent flex pack 300 while inserting the male portion of one flex pack into the female portion of an adjacent flex pack thereby making it easier to sister the two flex packs.

As best shown in FIG. 8, flex pack 300 is assembled by hub arm 336 and tabs 360 of hub 332 of elastomeric resistance element 304 being inserted through aperture 312 of back plate 302 such that tabs 360 pass through wings 314. Resistance element 304 is twisted slightly such that tabs 360 no longer align with wings 314 and bear against a back surface 310 of back plate 302. Projections 326 of front plate 306 are inserted through aperture 335 of resistance element 304. Front plate 306 and back plate 302 are aligned such that fastener members 362 of front plate 306 is inserted through apertures 364 of back plate 302 to couple front plate 306 to back plate 302. As shown in FIG. 4, resistance member 26 may be integrated into the device 10 and comprise only front plate 306 and resistance element 304 wherein front plate 306 is coupled directly to arm 14 as shown. Fastener member 362 may be a rivet, laser weld, spot weld, chemical weld, screw, bolt, adhesive, or any other fastener configuration now known or hereafter developed.

When flex pack 300 is resistance member 26, it may be "preloaded" when implemented into the device 10 to provide immediate resistance against relative rotation of arms 12 and 14. To this end, as shown in FIGS. 7 and 8, back plate 302 includes coupling arms 316 extending away from back surface 310 wherein coupling arms 316 include a hook 318. Front surface 320 of front plate 306 includes a plurality of tapered slots 324 wherein the depth of the slot tapers in a substantially arcuate shape. When a user wants to increase the resistance, he/she may sister a second flex pack 300 to the first flex pack 300 integrated into the device 10.

To sister the second flex pack 300 to the front plate of the first flex pack 300, the user will align the coupling arms 16 of back plate 302 of the second flex pack 300 with tapered slots 324 of the front plate of the first flex pack 300. The male portion 346 of the hub of the second flex pack 300 will engage the female portion of the hub of the first flex pack 300 thereby preventing the hub of the second flex pack 300 from rotating. The user will then rotate the rim of the second flex pack 300 within the tapered slot and substantially simultaneously press the second flex pack 300 toward the first flex pack 300 thereby decreasing the spacing between the flex pack 300 such that the inside and outside teeth align and engage. The hook 318 of the coupling arm 316 of the second flex pack 300 engages the tapered slot in front plate of the first flex pack 300 to temporarily couple the two flex packs. This motion preloads the elastomeric resistance element of the second flex pack 300 to insure the additional resistance will be immediately applied. One embodiment may include flex pack 300 being pre-loaded by rotating flex pack 300 in a range from ten (10) to one-hundred eighty (180) degrees; however, any degree of preload may be used. A preferred embodiment includes a preload of about thirty (30) to sixty (60) degrees. Moreover, the preloading of the flex pack 300 applies a frictional force between the inside teeth of the female portion of the hub of the first flex pack 300 and the outside teeth of the male portion of the hub of the second flex pack 300 thereby providing additional resistance against second flex pack 300 unintentionally separating from first flex pack 300. Additional flex packs may be added in a similar manner such that the user may add as much resistance as desired.

Another embodiment of resistance element 26 includes a plurality of triangular projections extending away from said second arm wherein one or more elastomeric resistance elements 304 as described above are slid over such projections to provide a the resistance desired by the user.

Figure 9:
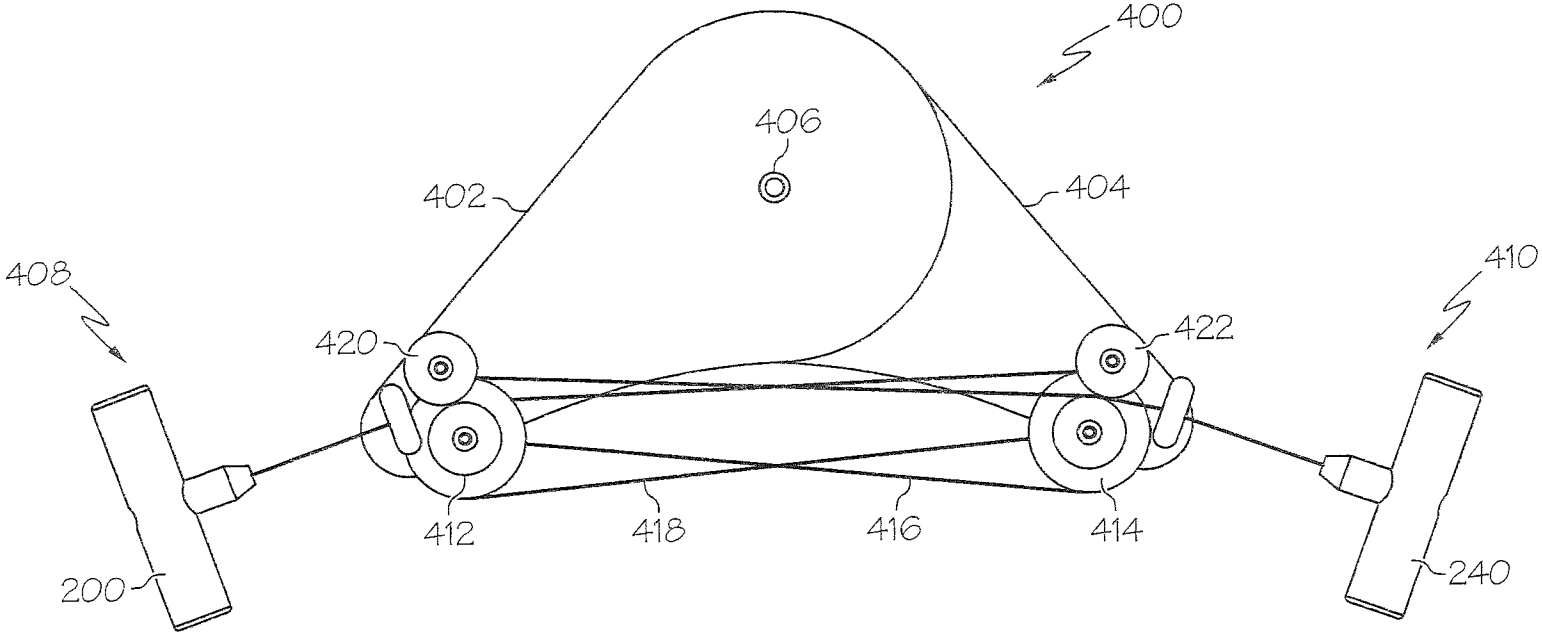
FIG. 9 is a front view of one embodiment of a personal exercise device in accordance with the teachings of the present invention.

FIG. 9 illustrates another embodiment of a personal exercise device 400 of the present invention. Personal exercise device 400 is substantially identical to the embodiments of personal exercise device 10 described above, including a first arm 402 pivotally coupled to a second arm 404 at a pivot point 406, first arm 402 includes a first handle assembly 408 operably connected thereto, and second arm 404 including a second handle assembly 410 operably connected thereto. Personal exercise device 400 further includes a first pulley 412 coupled to first arm 402 and a second pulley 414 coupled to second arm 404 as shown. Personal exercise device 400 further includes a first tension member 416 being operably connected to first handle assembly 408, engaged with second pulley 414, and then doubling back and returning first arm 402 where it is coupled thereto as shown. Similarly, personal exercise device 400 further includes a second tension member 418 operably connected to second handle assembly 410, engaging first pulley 412, and then doubling back and returning to second arm 404 wherein it is coupled thereto as shown. Personal exercise device 400 may also include a first stabilizing roller 420 coupled to first arm 402 to engage and support first pulley 412 and a second stabilizing roller 422 coupled to second arm 404 to engage and support second pulley 414. FIG. 9 also illustrates an alternative embodiment of handle 200 and 240 being a "T" shaped member. The resistance member (not shown) and resistance features of personal exercise device 400 are similarly configured to the embodiments described above.

In use, a user will select the resistance desired to perform the exercise. For example, an embodiment of the exercise device 10 of the present invention may include the first flex pack 300 attached directly to the device having about a five pound resistance. Other embodiments of flex pack 300 may include any starting resistance, including, but not limited to about two pounds, about seven pounds, about ten pounds, or about twenty pounds. A user may then sister one or more flex packs 300 together to create a customizable resistance for that particular exercise. For example, if the user is doing arm curls, he/she may choose an equivalent resistance of about twenty (20) pounds, and if the user is performing tricep extensions, he/she may choose an equivalent resistance of about ten (10) pounds.

Figure 10A:
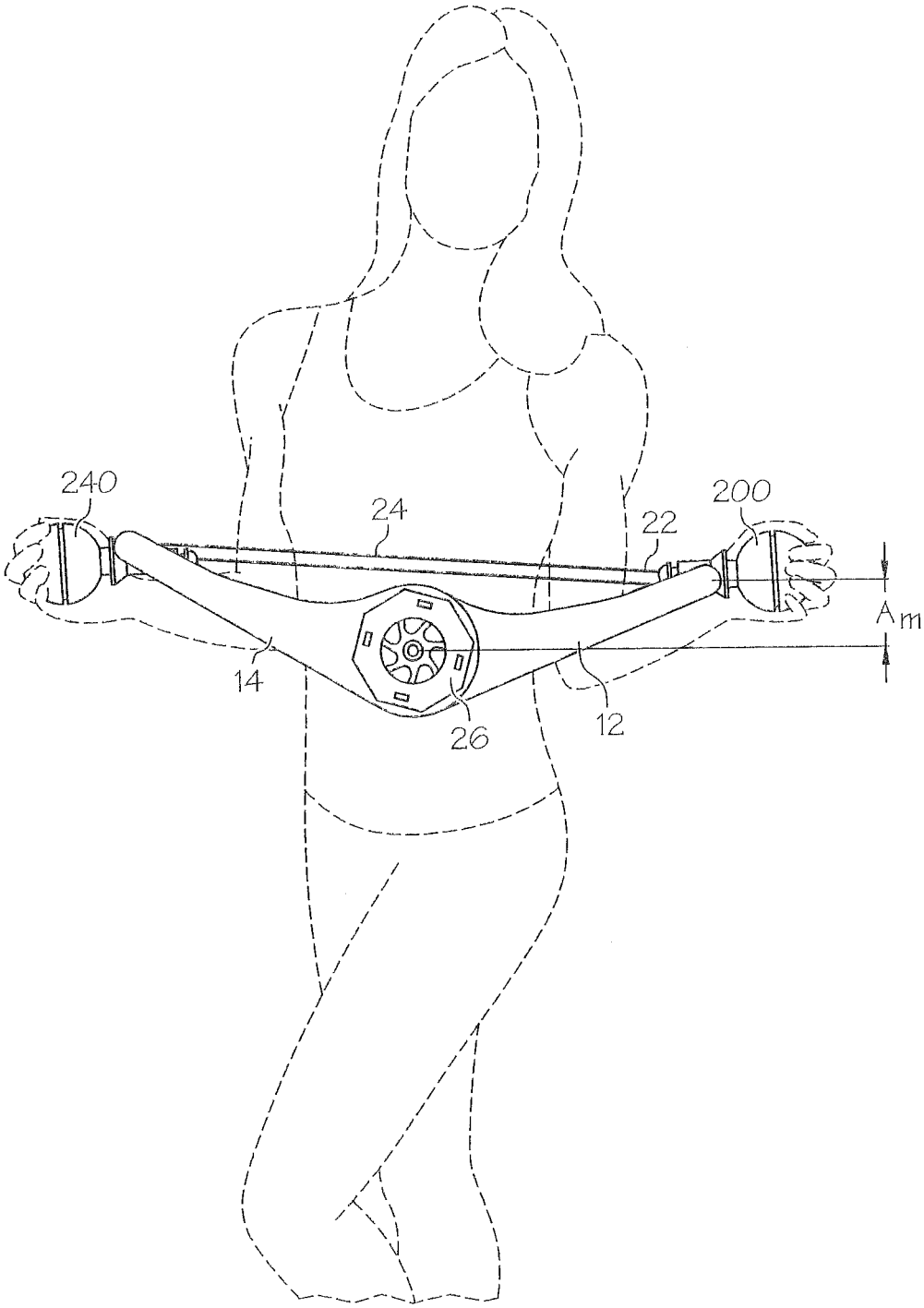
FIG. 10A is a front view of a user holding one embodiment of the personal exercise device in accordance with the teachings of the present invention in a neutral position.
Figure 10B:
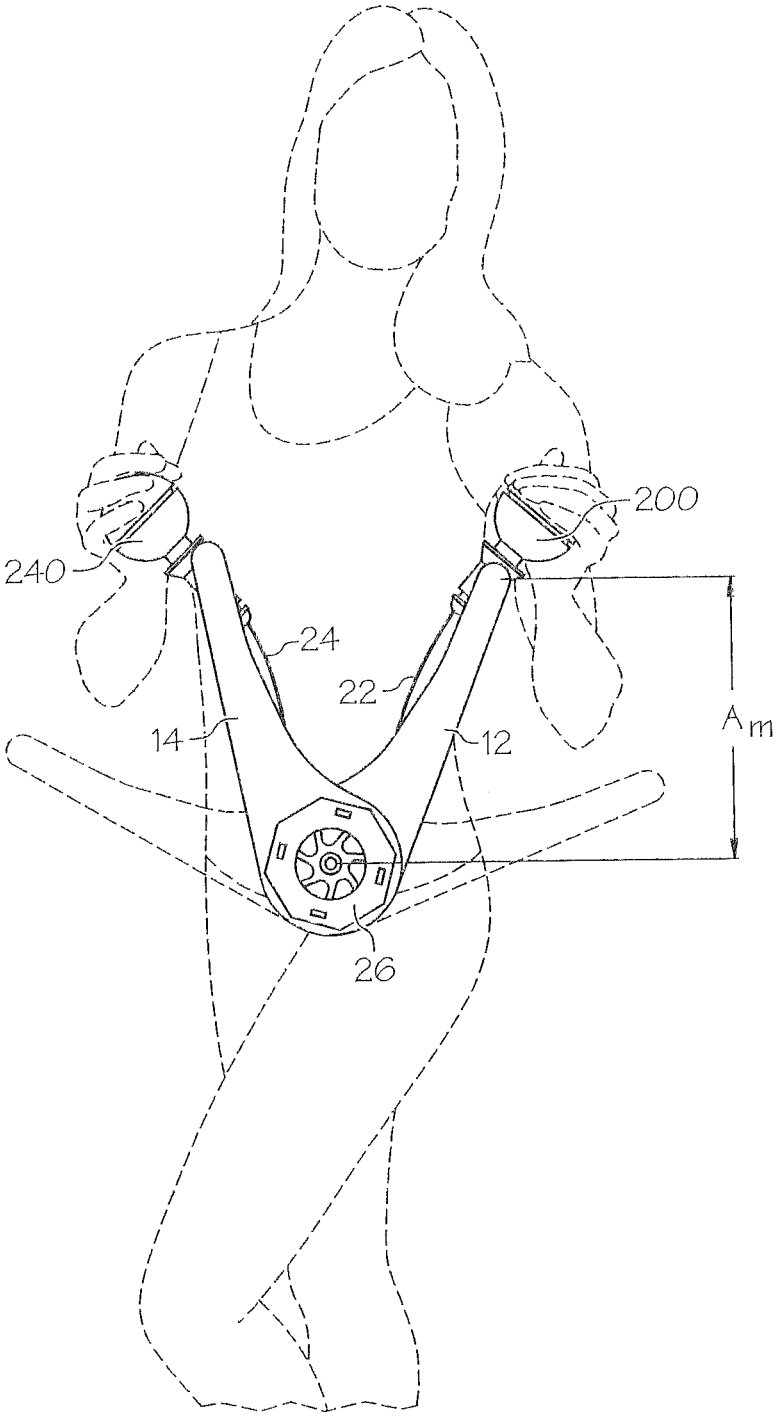
FIG. 10B is a front view of the embodiment of the personal exercise device of FIG. 10A after a user applies an adduction force.

One example of how the personal exercise device 10 of the present invention is used includes a user grabbing one handle 200 and 240 in each hand as shown in FIG. 10A. Because handle 200 and 240 is substantially spherical in one embodiment, the user can grip the handle 200, 240 from a variety of angles or positions. A user may apply an adduction force to handles 200 and 240 thereby resulting in the user's hands and handles 200 and 240 being moved toward each other against the resistance provided by resistance member 26. An adduction force is a force applied to handles 200 and 240 wherein handles 200 and 240 and ends 28 and 60 of arms 12 and 14 are moved toward each other by rotating about pivot point 16 as shown in FIG. 10B. The adduction force generally results in bringing the user's hands toward a center of the body or toward an adjacent body part during this exercise. Thus, exercises applying an adduction force may include, but are not limited to: arm curls, chest curls, chest compressions, leg curls, or leg adduction (moving legs toward each other at the thigh, knees, calves, or ankles).

Figure 10C:
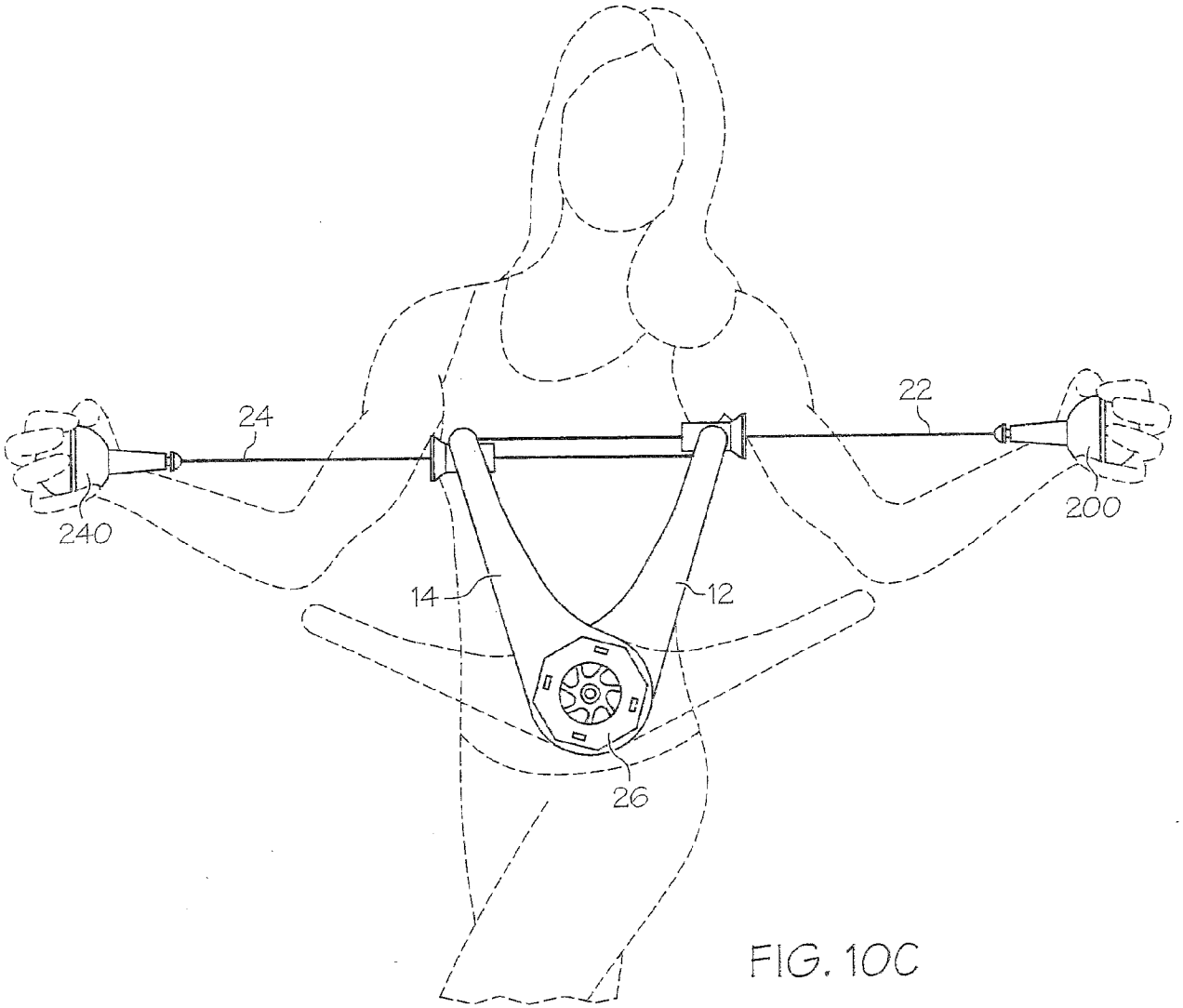
FIG. 10C is a front view of the embodiment of the personal exercise device of FIG. 10A after a user applies an abduction force.

Further, as shown in FIG. 10C, a user may also move handles 200, 240 in an abduction motion wherein the user pulls handles 200, 240 from sleeve 202, 242 and the user's hands and handles 200, 240 are being pulled away from each other. Abduction force is a force applied to the device 10 wherein the arms 12 and 14 are forced toward each other against resistance provided by resistance member 26 upon the movement of handles 200 and 240 away from each other. When handles 200 and 240 are pulled away from each other, tension members 22 and 24 transfer the abduction force applied to handles 200 and 240 to the opposite arm thereby resulting in a force applied to arms 12 and 14 that displaces the ends 28 and 60 toward each other by rotating about pivot point 16. Exercises applying an abduction force may include, but are not limited to: back rows, back flies, arm extensions, tricep extensions, leg extensions, leg abduction at the thighs, knees, calves, or ankles, or any other abduction-like motion.

The embodiment of FIG. 9 allows a user to substantially double the relative extension length of the handles 200 and 240 of the device 400 because of the configuration of the tension members 416 and 418 and pulleys 412 and 414. However, this configuration also reduces the equivalent resistance to approximately half of the resistance in the adduction direction and may not be desirable to some users because of that. Other users may desire this embodiment because often a user's strength in the abduction direction is less than his or her strength in the adduction direction and, as a result, this configuration more closely matches and resists the actual muscular strength profile of the user in the substantially opposing directions.

As shown in FIGS. 10A and 10B, the gradual increase in resistance provided by the elastomeric resistance element 304 of flex pack 300 while it is being continuously stretched in one embodiment is substantially offset by the increase in moment arm, $A_m$, resulting in a substantially uniform resistance force. As the two arms 12 and 14 are moved toward each other, the distance that the horizontal component of the applied force from the pivot point gradually increases thereby resulting in an increased moment arm. As such, the continual increase in the moment arm and resulting mechanical advantage substantially offsets the increase in resistance provided by the elastomeric resistance element as it continues to be stretched. The materials and cross-section of the resistance element may also be optimized to more perfectly match the increase in resistance with the increase in moment arm. This feature of the above embodiment provides a substantially consistent resistance force during the entire range of motion for a more realistic simulation of free weights.

Further, a user may use the device 10 of the present invention to workout opposing body parts at the same time without having to change his/her grip or change machines. A person may use the device 10 to compress the chest muscles by applying an adduction force upon the handles 200, 240 of device 10 as shown in FIG. 10B, and seamlessly reverse the motion and apply an abduction force in a fluid and continuous motion to handles 200, 240 without adjusting the grip on handles 200, 240 to effectuate a back "fly" or "row" exercise as shown in FIG. 10C.

Yet another embodiment of the present invention includes coupling a strap to at least one handle 200 and/or 204 and securing the strap by stepping on it, or wrapping it around a body part, such as one or more legs, or another fixed object. Thus, in this manner, the user can increase the types of exercises and ranges of motion that are capable to be performed through use of the personal exercise device of the present invention.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

We claim:

1. A personal exercise device comprising:

a first arm;

a second arm pivotally coupled to said first arm at a pivot point;

a first handle removably coupled to said first arm away from said pivot point;

a second handle removably coupled to said second arm away from said pivot point;

a first tension member operably connected between said first handle and said second arm;

a second tension member operably connected between said second handle and said first arm; and a resistance member operably connected to both the first arm and the second arm and configured to resist the relative rotational motion of the first arm toward the second arm;

wherein said resistance member is engaged to provide resistance against said first and second arms pivoting towards each other when said first and second handles are pushed towards each other and said resistance member is engaged to provide resistance against said first and second arms pivoting towards each other when said first and second handles are pulled away from each other and away from said first and second arms respectively such that said first and second tension members pull said second and first arms respectively towards each other.

2. The exercise device of claim 1 wherein said handles can be moved in two directions without a user changing a grip upon said handles.

3. The exercise device of claim 1 wherein said first arm has a first end and a second end and wherein said second arm has a first end and a second end and said second end of said first arm is pivotally coupled to said second end of said second arm.

4. The exercise device of claim 3 wherein said first end of said first arm and said first end of said second arm include a fork having a first leg and a second leg and wherein said first handle is positioned between said first and said second legs of said fork of said first arm and said second handle is positioned between said first and second legs of said fork of said second arm.

5. The exercise device of claim 1 wherein said first arm includes a first sleeve pivotally coupled thereto and wherein said first handle removably nests within said first sleeve, and wherein said second arm includes a second sleeve pivotally coupled thereto and wherein said second handle removably nests within said second sleeve.

6. The exercise device of claim 5 wherein said handles are configured such that a user does not have to change a grip when changing between pushing said first and second handles toward each other and pulling said first and second handles away from each other.

7. The exercise device of claim 1 wherein said handles comprise a handhold having a substantially spherical shape.

8. The exercise device of claim 1 wherein at least a portion of said resistance member is elastomeric.

9. The exercise device of claim 8 wherein said resistance member is a first flex pack having a first elastomeric resistance element and a first front plate, wherein said first front plate is coupled to said second arm and said first elastomeric resistance element is positioned between said second arm and said front plate, and said first elastomeric resistance element is operably connected to at least said front plate and said first arm.

10. The exercise device of claim 9 wherein said resistance member further includes a second flex pack wherein said second flex pack comprises a second back plate, a second elastomeric resistance element, and a second front plate, wherein said front plate is coupled to said back plate with said second elastomeric resistance element positioned therebetween, and said first front plate of said first flex pack is configured to receive said second back plate of said second flex pack, and wherein said back plate of said second flex pack is configured to be removably coupled to said first front plate of said first flex pack and said second elastomeric resistance element is configured to operably engage said first elastomeric resistance element.

11. The exercise device of claim 10 wherein said second elastomeric resistance element includes a hub, a rim and a plurality spokes extending between said hub and said rim, and wherein said hub includes a hub arm configured to matingly engage with said first elastomeric resistance element when said second flex pack is removably coupled to said first flex pack.

12. The exercise device of claim 11 wherein said second elastomeric resistance element is preloaded by engaging said hub of said second elastomeric resistance element with said first elastomeric resistance element and rotating said second flex pack relative to said first flex pack.

13. The exercise device of claim 10 wherein said back plate of said second flex pack includes a plurality of coupling arms extending away therefrom and said first front plate of said first flex pack includes a plurality of tapered slots configured to receive said coupling arms of said back plate of said second flex pack to removably couple said second flex pack to said first flex pack.

14. The exercise device of claim 13 wherein said coupling arms further include a hook configured to engage said tapered slots to removably couple said second flex pack to said first flex pack.

15. The exercise device of claim 9 wherein said first tension member is operably connected to said second arm and said second tension member is operably connected to said first arm.

16. A personal exercise device comprising:

a first arm having a first end and a second end;

a second arm having a first end and a second end wherein said second end of said second arm is pivotally coupled to said second end of said first arm at a pivot point;

a first handle assembly having a first handle and a first sleeve, said first handle assembly operably connected to said first arm proximate said first end;

a second handle assembly having a second handle and a second sleeve, said second handle assembly operably connected to said second arm proximate said first end;

a first tension member operably connected to said first handle and said second sleeve;

a second tension member operably connected to said second handle and said first sleeve; and a resistance member operably connected to both said first arm and said second arm and configured to provide resistance against relative motion between said first arm and said second arm;

wherein said handles removably nest in said sleeves and said tension members and said arms are configured to engage said resistance member when a user applies either an adduction force or an abduction force to said handles.

17. The exercise device of claim 16 wherein said handles are configured such that a user does not have to change a grip when changing the application of force applied to said handles between the adduction force and the abduction force.

18. A personal exercise device comprising:

a first arm having a first end and a second end wherein said first arm further includes a first sleeve operably coupled to said first arm proximate said first end, said first arm further including a first handle removably nestable in said first sleeve;

a second arm having a first end and a second end wherein said second arm includes a second sleeve operably coupled to said second arm proximate said first end, said second arm further including a second handle removably nestable in said second sleeve wherein said second end of said second arm is pivotally coupled to said second end of said first arm;

a first tension member having a first end and a second end wherein said first end of said first tension member is operably coupled to said first handle and said second end of said first tension member is operably coupled to said second sleeve;

a second tension member having a first end and a second end wherein said first end of said second tension member is operably coupled to said second handle and said second end of said second tension member is operably coupled to said first sleeve; and a resistance member operably connected to both said first arm and said second arm and configured to provide resistance to relative motion between said first arm and said second arm; and wherein a user encounters a resistance force when applying either an abduction force or an adduction force to said handles.

19. The exercise device of claim 18 wherein said resistance member comprises one or more flex packs operably connected to at least said first arm and said second arm.

20. A personal exercise device comprising:

a first arm;

a second arm pivotally coupled to said first arm at a pivot point;

a first handle removably coupled to said first arm away from said pivot point;

a second handle removably coupled to said second arm away from said pivot point; and at least one resistance member providing resistance against pivoting of said first and second handles towards each other, wherein said at least one resistance member is engaged to provide resistance against said first and second arms pivoting towards each other when said first and second handles are pushed towards each other and said at least one resistance member is engaged to provide resistance against said first and second arms pivoting towards each other when said first and second handles are pulled away from each other and away from said first and second arms respectively.

* * * * *